US005505679A

United States Patent [19]

McBride et al.

[11] Patent Number: 5,505,679

[45] Date of Patent: Apr. 9, 1996

[54] RECUMBENT LEG AND ARM STEPPING EXERCISING APPARATUS

[75] Inventors: Robert W. McBride, Sunrise, Fla.; Lin Siz-Pin, Taichung Hsien, Taiwan

[73] Assignee: Formula Ventures, Inc., North Miami Beach, Fla.

[21] Appl. No.: 177,086

[22] Filed: Jan. 4, 1994

[51] Int. Cl.[6] ..... A63B 22/04

[52] U.S. Cl. ..... 482/53; 482/52; 482/112; 482/73

[58] Field of Search ..... 482/111, 112, 482/130, 142, 52, 53, 72, 73, 137, 96

[56] References Cited

U.S. PATENT DOCUMENTS

| | | |
|---|---|---|
| 326,247 | 9/1885 | Root . |
| 1,176,365 | 3/1916 | Hartnett . |
| 4,188,030 | 2/1980 | Hooper . |
| 4,618,139 | 10/1986 | Haaheim . |
| 4,684,126 | 8/1987 | Dalebout et al. . |
| 4,838,543 | 6/1989 | Armstrong et al. . |
| 4,850,585 | 7/1989 | Dalebout . |
| 4,940,233 | 7/1990 | Bull et al. . |
| 4,971,316 | 11/1990 | Dalebout et al. . |
| 5,004,224 | 4/1991 | Wang . |
| 5,104,363 | 4/1992 | Shi ..... 482/73 |
| 5,129,872 | 7/1992 | Dalton et al. . |
| 5,254,067 | 10/1993 | Habing et al. . |

OTHER PUBLICATIONS

Image Gold advertisement from "Shape", Nov. 1993, p. 131.

*Primary Examiner*—Lynne A. Reichard

*Attorney, Agent, or Firm*—Rosen, Dainow & Jacobs

[57] ABSTRACT

A recumbent leg and arm exercising machine is disclosed which may be used as a rower, a stepper and/or to perform a bench press-type exercise. The machine may also be used to exercise only the arms, only the legs, as well as both the arms and the legs. The exercising machine includes a seat, foot levers and arm levers, and is constructed so that the apparatus may be used for synchronized exercises in which selected or all levers move in synchronism. In accordance with the preferred embodiment, the exercising machine includes right foot and arm levers coupled to move in synchronism in opposite directions, and left foot and arm levers coupled to move in synchronism in opposite directions. Preferably, the right levers and the left levers operate independently of each other. However, in alternate embodiments, the right and left levers may also be coupled to move in synchronism, so that the apparatus operates either as a rower or as a stepper, depending upon the arrangement for coupling the levers. The starting position of the arm levers is adjustable, and the resistance is adjustable externally of the resistance device, i.e., by adjusting the linkage system which links the resistance devices and the levers. The arm levers are removable so that the foot levers may be used alone. The foot levers and arm levers are linked by a linkage system which places piston and cylinder resistance devices rearwardly of the seat.

13 Claims, 11 Drawing Sheets

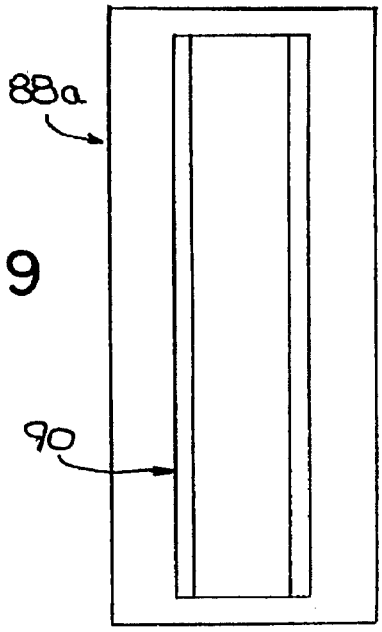
FIG. 19
FIG. 18
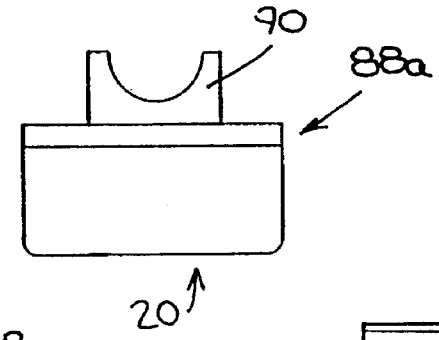
FIG. 16
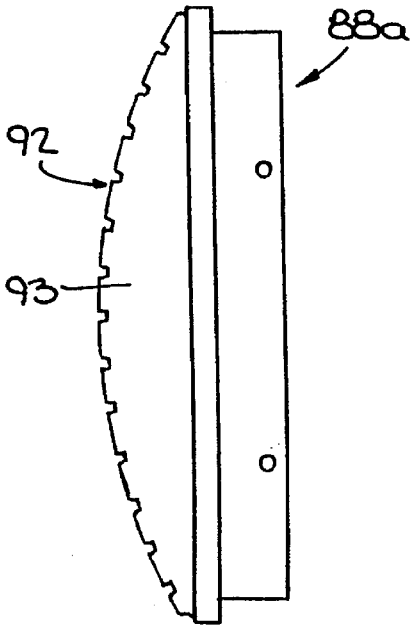
FIG. 17
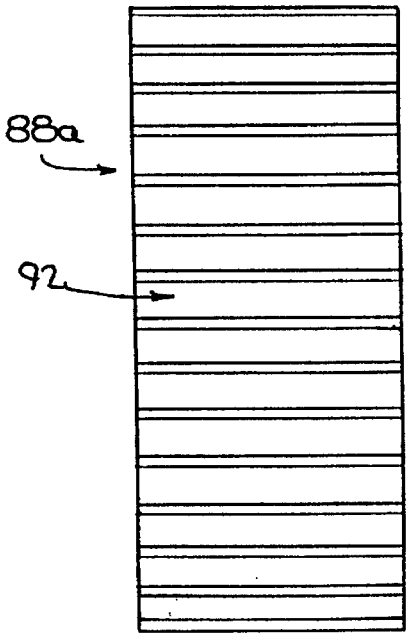

RECUMBENT LEG AND ARM STEPPING EXERCISING APPARATUS

The invention disclosed herein relates to exercising apparatus with which an exerciser may exercise his or her lower body and/or upper body. More specifically, the invention relates to such apparatus in which the exerciser may exercise his or her legs and arms from a position generally recumbent from the hip to the feet, which position will be referred to herein simply as "recumbent" or "recumbent position".

U.S. Pat. No. 4,684,126 (Dalebout et al.) discloses an exercise machine which includes a pair of leg levers, a pair of arm levers and a seat in which an exerciser may sit in a recumbent position while rotating respective foot levers with his or her feet and respective arm levers with his or her arms. A recumbent stepper exercise machine advertised in "Shape" magazine, November 1993 by Image Inc. similarly includes pairs of rotatable leg and arm levers and a seat in which an exerciser may sit in a recumbent position while rotating the foot and arm levers. In both the exercise machine disclosed in the '126 Patent and the advertised Image Inc. stepper, a separate resistance device is coupled to each foot lever and to each arm lever to resist rotation thereof, and movement of the foot and arm levers is not synchronized in any way.

OBJECTS AND SUMMARY OF THE INVENTION

It is an object of the invention disclosed herein to provide recumbent leg and arm exercising apparatus in which movement of levers to which force is applied by the arms and legs is synchronized.

It is another object of the invention to provide recumbent exercising apparatus having first and second foot levers and first and second arm levers, in which movement of the first foot lever and the first arm lever is synchronized and movement of the second foot lever and the second arm lever is synchronized. Another object is to provide such apparatus which may be used as a rower or stepper without any adjustment or modification of the apparatus.

It is another object of the invention to provide such recumbent leg and arm exercising apparatus having first and second foot and arm levers in which movement of both foot levers and both arm levers is synchronized. Another object is to provide such apparatus which is configured for use either as a recumbent stepper or as a rower.

It is another object of the invention to provide apparatus which satisfies any of the above objects and which can additionally be used to perform a bench press type exercise.

It is another object of the invention to provide a leg and/or arm exercising apparatus in which the exerciser sits in a recumbent position and which is of reduced cost and is simple to manufacture.

Leg and/or arm exercising apparatus which achieve the above and other objects are provided in accordance with the invention for exercising one's arm or legs, or both arms and legs, while the exerciser is in a recumbent position. Such exercising apparatus according to the invention include a seat, foot levers and arm levers, and are constructed so that the apparatus may be used for synchronized exercises in which selected or all levers move in synchronism.

In accordance with the preferred embodiment, a recumbent leg and/or arm exercising apparatus includes first foot and arm levers (e.g., for the right foot and right arm, respectively) coupled to move in synchronism, and second foot and arm levers (e.g., for the left foot and left arm, respectively) coupled to move in synchronism. Preferably, the first levers (foot and arm) and the second levers (foot and arm) operate independently of each other. Apparatus according to the preferred embodiment may be used as a rower, as a stepper, and/or to perform a bench press-type exercise without adjustment or modification. However, in alternate embodiments, the first and second levers may also be coupled to move in synchronism, so that the apparatus operates either as a rower or as a stepper, depending upon the arrangement for coupling the levers. In these embodiments, the apparatus may also be used to perform a bench press-type exercise.

In the preferred embodiments, the first foot and arm levers are linked to move in synchronism in opposite directions, and the second foot and arm levers are linked to move in synchronism opposite directions. Also, means for resisting movement of the levers are coupled to provide more resistance against movement of the foot levers in a first direction than in an opposite, second direction, and more resistance against movement of the arm levers in the second direction than in the first direction. Preferably, the resistance means provides little or substantially no resistance against movement of the foot levers in the second direction and against movement of the arm levers in the first direction. This facilitates use of the exercising apparatus as a rower or stepper, while permitting use of the apparatus to perform a bench press-type exercise.

Exercising apparatus according to the invention comprises the first foot lever, the first arm lever, the second foot lever, the second arm lever, all pivotally mounted to the apparatus, the seat, and the means for resisting pivoting of the levers which comprises first and second independent resistance devices coupled, respectively, to the first foot and arm levers and the second foot and arm levers. In the preferred embodiments, the first and second resistance devices are first and second hydraulic (or pneumatic) piston and cylinder devices (hereafter referred to as piston/cylinder devices).

Leg and arm exercising apparatus according to the invention also comprises a frame to which the seat is attached, with the first and second foot levers being coupled to the frame (e.g., at a base support thereof) to pivot in the first and second opposite directions, and with the first and second arm levers coupled to the frame and respectively to the first and second foot levers so that the first foot lever and the first arm lever pivot in synchronism and the second foot lever and the second arm lever pivot in synchronism. The apparatus is constructed so that an exerciser seated on the seat may exert force on respective foot levers with his or her respective feet, and on respective arm levers with his or her respective hands. The independent resistance devices resist the synchronized pivoting of the first foot lever and the first arm lever, and the synchronized pivoting of the second foot lever and the second arm lever.

In the preferred embodiments, each of the foot levers has a foot receiving portion positioned forwardly of the seat so that an exerciser seated on said seat may exert force on the foot receiving potions to pivot the foot lever. Also, in the preferred embodiments, the foot levers are pivoted to the apparatus forwardly of the seat, e.g., at a forward base support of the apparatus.

A first linkage system couples the first foot lever, the first arm lever and the first resistance device such that the first resistance device resists pivoting of the first foot lever and the first arm lever when they are being pivoted in opposite directions, and a second linkage system couples the second foot lever, the second arm lever and the second resistance device such that the second resistance device resists pivoting of the second foot lever and the second arm lever when they are being pivoted in opposite directions.

In the preferred embodiments, the first and second linkage systems comprise first and second linking elements or braces fixed to the first and second arm levers, respectively, means pivotally coupling the first and second braces to the frame such that pivoting of the first and second arm levers pivots the first and second braces, respectively, relative to the frame, means pivotally coupling the first and second braces to the first and second foot levers, respectively, such that the first foot lever and the first arm lever pivot in synchronism in opposite directions and the second foot lever and the second arm lever pivot in synchronism in opposite directions. The means coupling the braces to the foot levers comprises first and second links, respective means for pivotally connecting respective first and second braces to respective first and second links, and respective means for pivotally connecting respective first and second links to respective first and second foot levers.

Respective means are provided for pivotally coupling respective first and second braces to respective pistons of the first and second piston/cylinder devices. The respective means for pivotally connecting respective links and respective foot levers preferably pivotally connect them at any of a plurality of spaced locations along respective foot levers, whereby the resistance to pivoting of respective foot levers may be adjusted externally of the resistance devices.

Means are provided for adjusting the position of the first arm lever relative to the seat at at least one of the end points of an exercise cycle for the first arm lever, and for adjusting the position of the second arm lever relative to the seat at at least one of the end points of the exercise cycle for the second arm lever.

The frame preferably comprises a first piece having a portion extending forwardly of the seat and a second piece having a portion extending rearwardly of the seat, and means removably connecting the first and second pieces together. This facilitates shipping of the apparatus.

Preferably the first and second arm levers are attached to the apparatus such that each of them may be removed from the apparatus without affecting the pivoting of the first and second foot levers. This allows the apparatus to be used solely as for leg exercisers.

In the preferred embodiment where the first and second resistance means provide substantial resistance to pivoting of the foot levers in the first direction and the arm levers in the second direction, and little or substantially no resistance to pivoting of the foot levers in the second direction and the arm levers in the first direction, the resistance devices preferably include means for urging a respective piston of a respective resistance device to cause respective foot levers and respective arm levers to move towards each other and rest at a start position of the exercise cycle.

In the preferred embodiments, two hydraulic independent action, spring-return piston/cylinder devices are provided as the resistance means which are positioned below and behind the seat while being coupled to foot levers which have foot receiving portions located forwardly of the seat.

In the preferred embodiments, the first foot lever and the first arm lever are positioned on the right side of the apparatus to which force may be applied by a seated exerciser's right leg and right arm, respectively, and the second foot lever and the second arm lever are positioned on the left side of the apparatus to which force may be applied by a seated exerciser's left foot and left arm, respectively.

BRIEF DESCRIPTION OF THE DRAWINGS

The invention is illustrated in the figures of the accompanying drawings which are meant to be exemplary and not limiting, in which like numerals refer to like or corresponding parts, and in which:

FIG. 16 is a side view of a foot pedal of the apparatus depicted in FIG. 14;

FIG. 17 is a front view of the foot pedal depicted in FIG. 16;

FIG. 18 is a top plan view of the foot pedal depicted in FIG. 16; and;

FIG. 19 is a rear view of the foot pedal depicted in FIG. 16.

DESCRIPTION OF THE PREFERRED EMBODIMENTS

Figure 1:
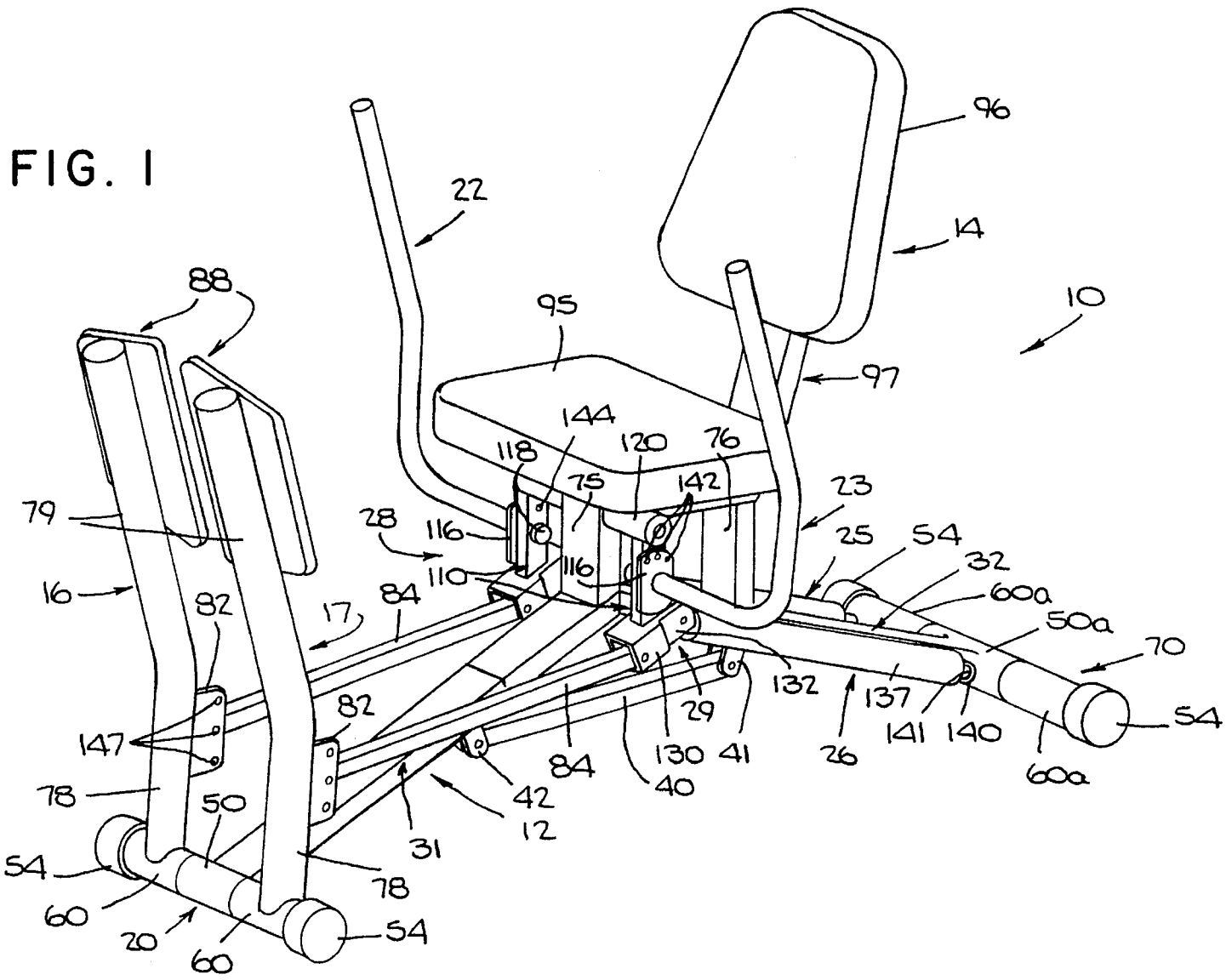
FIG. 1 is a perspective view of leg and arm exercising apparatus according to one embodiment of the invention showing arm and foot levers in a starting position of an exercise cycle.

Referring to FIG. 1, a recumbent leg and arm exercising apparatus 10 according to the invention comprises a frame 12, a seat 14 attached to the frame 12, right (first) and left (second) foot levers 16, 17 pivotally mounted to a front support base or stabilizer 20, right (first) and left (second) arm levers 22, 23 pivotally mounted to the frame 12, right (first) and left (second) hydraulic resistance devices 25, 26, a right-side (first) linkage system 28 linking the right foot lever 16, the right arm lever 22 and the right resistance device 25, and a left-side (second) linkage system 29 linking the left foot lever 17, the left arm lever 23 and the left resistance device 26.

Figure 3:
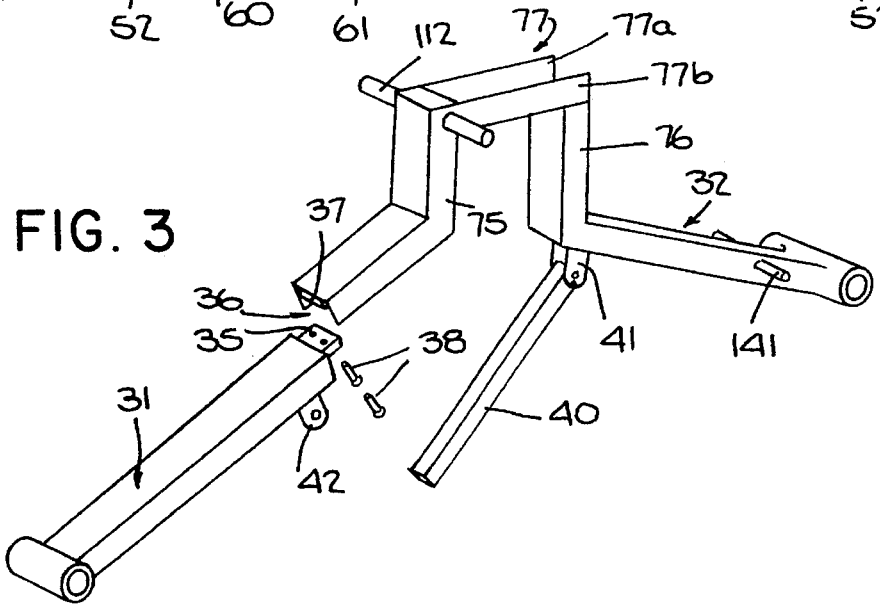
FIG. 3 is a perspective, exploded view of the frame of the apparatus depicted in FIG. 1.

Referring to FIGS. 1 and 3, the frame 12 includes a front piece 31 and a rear piece 32 which are separate pieces that are assembled together after the apparatus has been shipped from the factory. Constructing the frame in two pieces facilitates shipping from factory to consumer. The means for joining the two pieces 31 and 32 of the frame are such that the frame may be assembled by an average consumer without special tools (or by a simple tool such as an Allen wrench which may be shipped with the apparatus). In the embodiment depicted in the drawings, pieces 31 and 32 are removably fastened together. Front piece 31 terminates in a reduced size projection 35 (FIG. 3) which is received in a like-shaped recess 36 in rear piece 32. Screws 38 pass through holes in projection 35 and are threadedly received in a boss 37 in recess 36. A brace 40, which is pivotally connected to the rear piece 32 by a bracket 41 and removably fastened to the front piece 31 by a bracket 42 and a screw (not shown), is provided to reinforce the two-piece frame 12. Alternatively, the frame 12 may be made one piece, and the brace 40 may be eliminated. Also, other means for joining the two frame pieces may be used, and pieces 31 and 32 may be pivotally fastened together so that the frame 12 may be folded to reduce its overall size.

Figure 2:
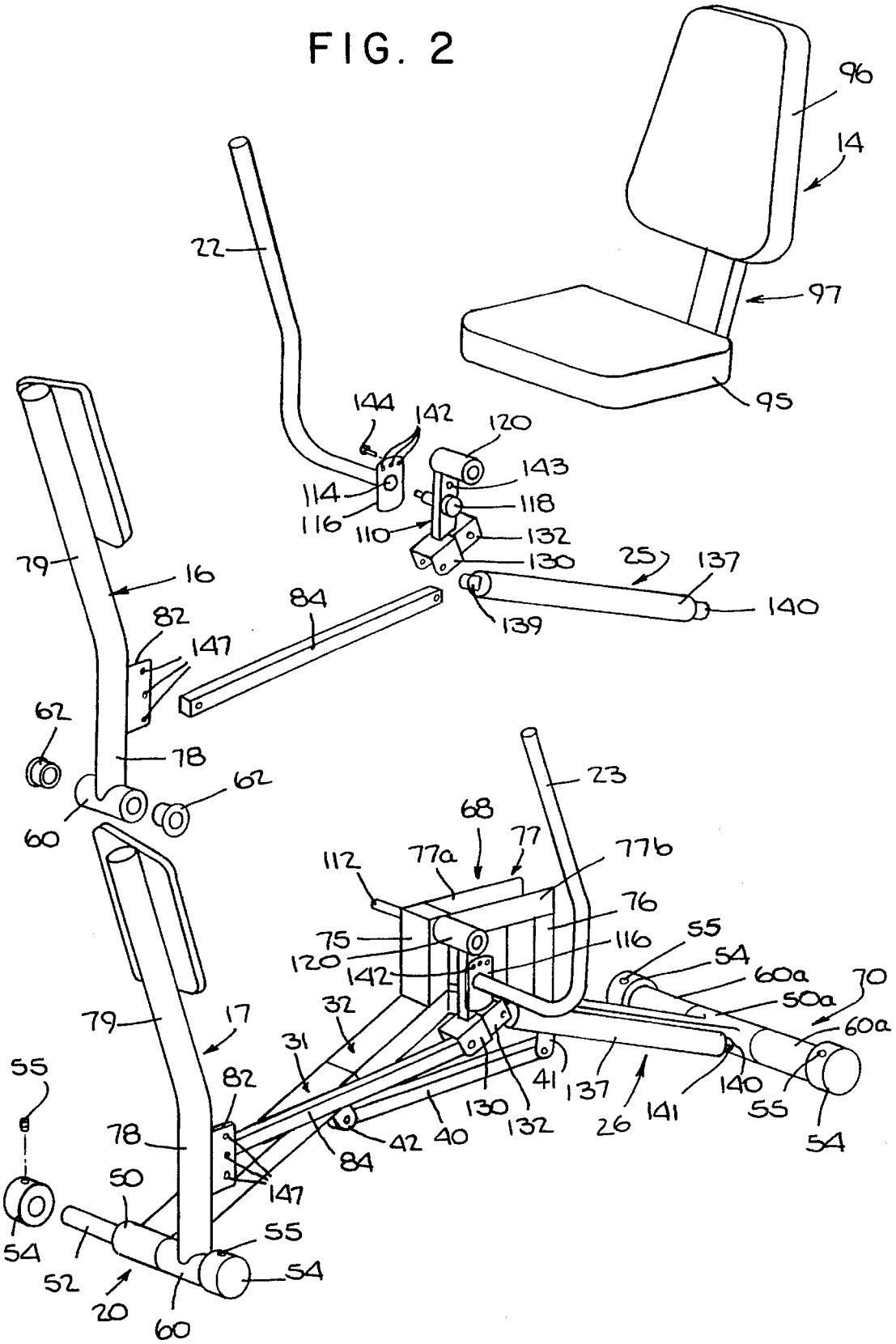
FIG. 2 is a perspective, partially exploded view of the exercising apparatus depicted in FIG. 1.
Figure 5:
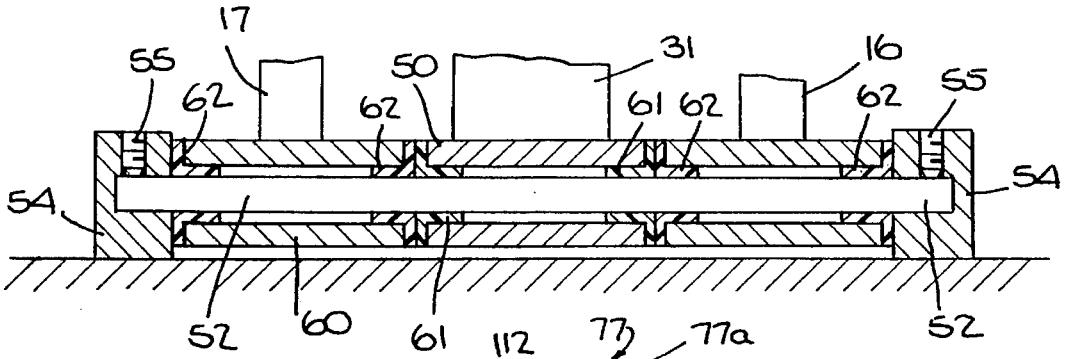
FIG. 5 is a cross-sectional view of the front base element or stabilizer of the apparatus depicted in FIG. 1 taken along line 5—5 in FIG. 6, shown with the foot levers and frame broken away.

Referring to FIGS. 2 and 5, the front piece 31 of the frame 12 is connected to the front stabilizer 20 which includes a hollow tube 50 fixed to a forward end of the front piece 31, a shaft 52 which rotatably passes through the hollow tube 50, and end caps 54 which are fixed, for example by set screws 55, to opposite ends of the shaft 52. The end caps 54 have a slightly larger outer diameter than that of the hollow tube 50 and the shaft 52 is rotatably received in bushings 61 (FIG. 5) fixed to the hollow tube 50, so that the end caps 54 rotate with the shaft 52. The end caps 54 may thus function as wheels when apparatus 10 is lifted from the rear and moved while the front stabilizer 20 rotatably supports the apparatus 10.

Referring to FIG. 2, the foot levers 16, 17 each terminate at their respective bottom ends in a hollow tube 60 which is rotatably (pivotally) coupled to the shaft 52 by bushings 62 fixed to opposite ends of the foot lever tubes 60. The shaft 52 is rotatably received in the bushings 62. Thus, the shaft 52 (and the end caps 54) rotate independently of the foot levers 16, 17.

Figure 14:
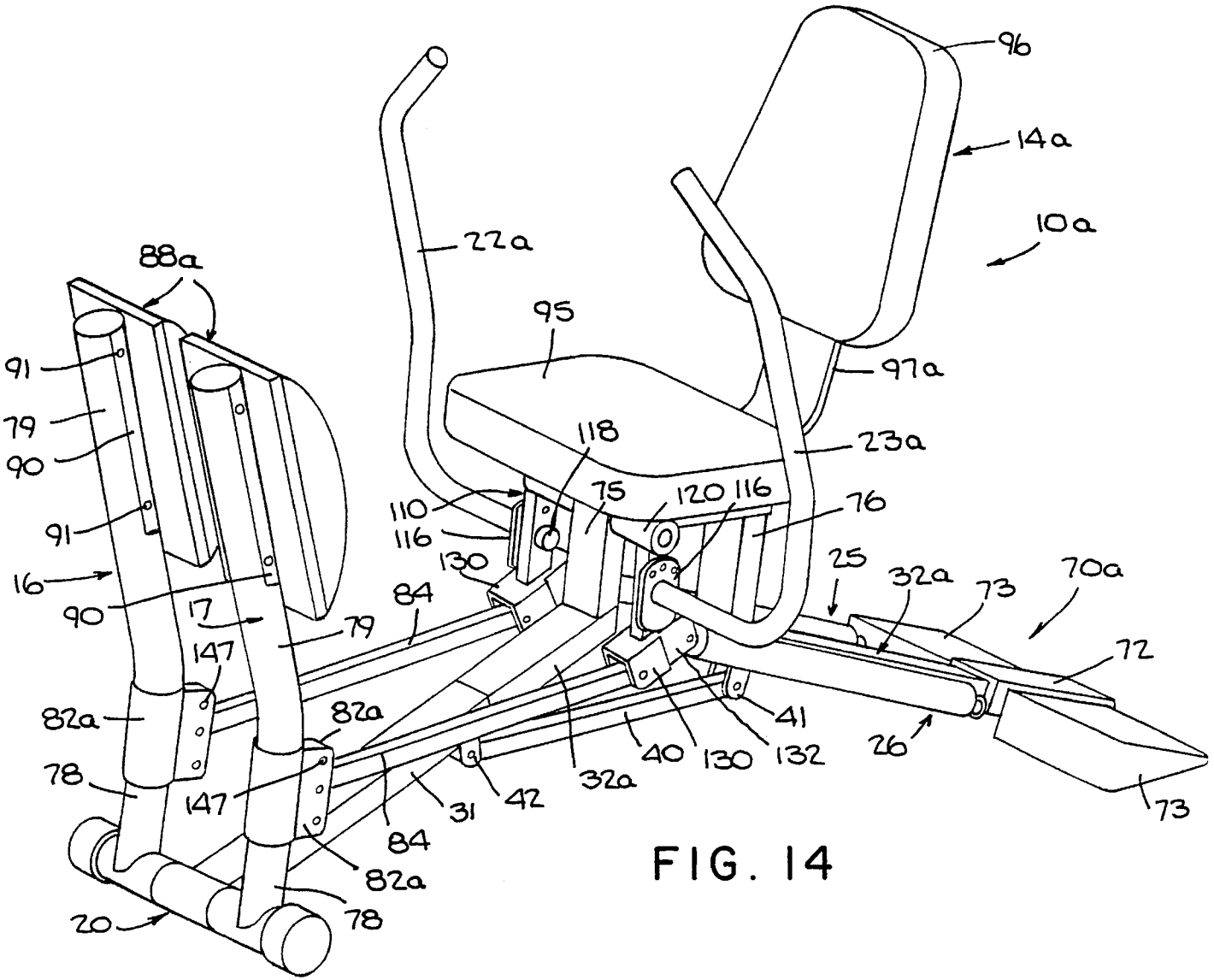
FIG. 14 is a perspective view of leg and arm exercising apparatus according to a presently preferred embodiment of the invention similar to the embodiment of FIG. 1 but with different foot pedals and a different rear stabilizer.

Referring to FIGS. 2 and 3, the front piece 31 of the frame 12 extends from the front stabilizer 20 upwardly and rearwardly towards a central portion 68, and the rear piece 32 extends from a rear support base or stabilizer 70 upwardly and forwardly towards the frame central portion 68. The frame rear piece 32 ends in a hollow tube **50*a* which is connected to the rear stabilizer 70, which may be constructed similar to the front stabilizer 20 with end caps 54 being fixed to a shaft (not shown) that is rotatably mounted within tubes 50*a* and 60*a*, or the end caps 54 may simply be fixed to tubes 60*a* which in turn are fixed to tube 50*a* connected to the frame rear piece 32. Alternatively, the rear stabilizer 70*a* may be constructed as in exercising apparatus 10a shown in FIG. 14, where the end of the rear frame piece 32*a* telescopes into and is fixed to a central receptacle 72 of the rear stabilizer 70*a*, which in turn is connected at opposite sides to wedge-shaped feet 73**.

Referring to FIGS. 2 and 3, the frame central portion 68 is part of the rear frame piece 32, and includes two spaced, vertically-extending segments 75, 76 joined by a horizontal segment 77 comprised of parallel, spaced bars **77*a* and 77*b*. The seat 14 is adjustably attached to the horizontal segment 77** as described below.

Figure 15:
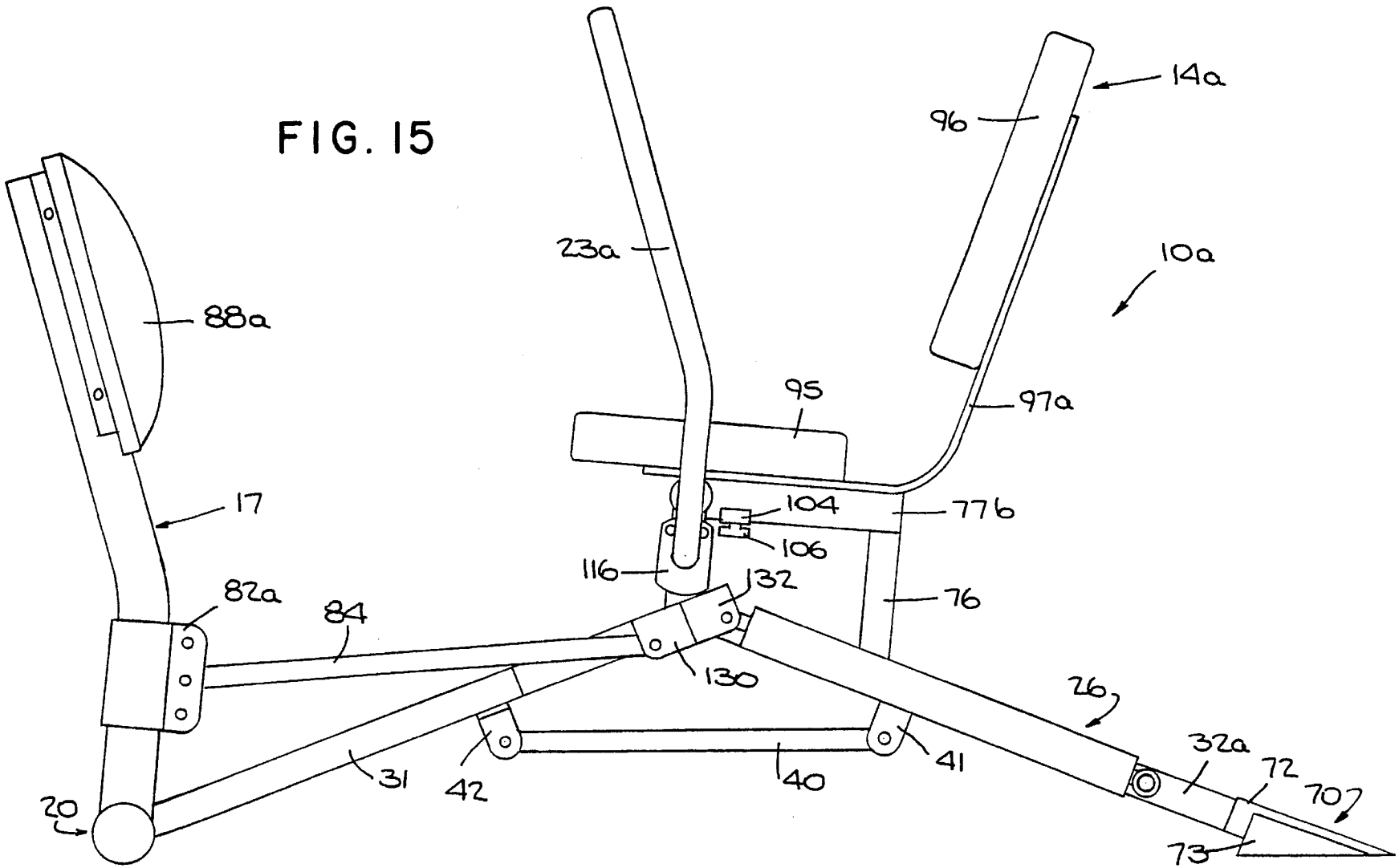
FIG. 15 is a side view of the apparatus depicted in FIG. 14.

The foot levers 16, 17 (FIG. 1) each include a lower portion 78 which extends vertically from the front stabilizer 20, and an upper portion 79 which angles from the lower portion 78 forwardly away from the seat 14. A bracket 82 with vertically-spaced holes in it is attached to the lower portion 78 of each foot lever slightly below the point at which the lower and upper foot lever portions 78 and 79 meet. The forward end of a link 84 is pivotally mounted to each bracket 82 by means of a bolt and nut (not shown). The purpose of the links 84 is discussed below. Bracket 82 may be attached to a respective foot lever 16, 17 in any suitable manner, e.g. by welding, fasteners, etc. In the embodiment of exercising apparatus **10*a* depicted in FIGS. 14 and 15, bracket 82*a* is in the form of a clamp which surrounds the lower foot lever portion 78 and is clamped thereto by a bolt (not shown) which also pivotally connects link 84 to the bracket 82*a***.

Referring to FIG. 1, a foot pedal 88 is attached to the upper portion 79 of each foot lever 16, 17. The foot pedals 88 may be generally flat as shown in FIGS. 1 and 2, and attached to the lever portions 79 in any suitable manner, e.g., by welding, fasteners, etc. In the embodiment of apparatus **10*a* shown in FIGS. 14–19, foot pedals 88*a* each include a semi-circular portion 90 centered on the rear of the foot pedal running from top to bottom thereof in which is received the upper portion 79 of a respective foot lever. Bolts 91 passing through the semi-circular portion 90 and the lever upper portions 79 and respective nuts (not shown) attach the foot pedals 88*a* to the foot levers. Each foot pedal 88*a* (FIGS. 16–19) may be covered by a non-skid surface, e.g., a tread 92, or padded (FIG. 16) to provide a good grip. Each foot pedal 88*a* may be shaped, e.g., include a pedal surface 93 which is curved from top to bottom as shown in FIGS. 16–19 to permit a recumbent exerciser to apply pressure to the foot pedals over a larger surface area and distribute the area of the foot which applies the pressure to the foot pedal, as opposed to a flat surface (FIG. 1**) where the tendency would be to apply more pressure with the heel of the foot. The particular tread pattern and foot pedal shape are also selected for esthetics, and different tread patterns and different foot pedal shapes (and/or foot lever configurations) may perform the functions described above.

Figure 4:
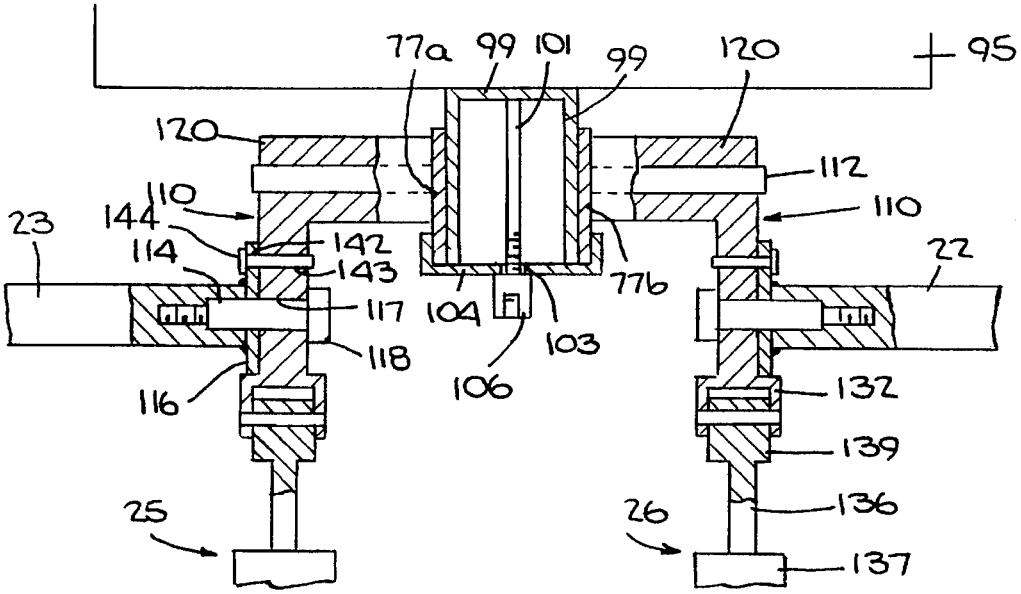
FIG. 4 is a cross-sectional view of part of the linkage system for the foot levers, arm levers and resistance devices of the apparatus depicted in FIG. 1 taken along line 4—4 in FIG. 6, shown with the arm levers and resistance devices broken away and the seat shown in outline.
Figure 6:
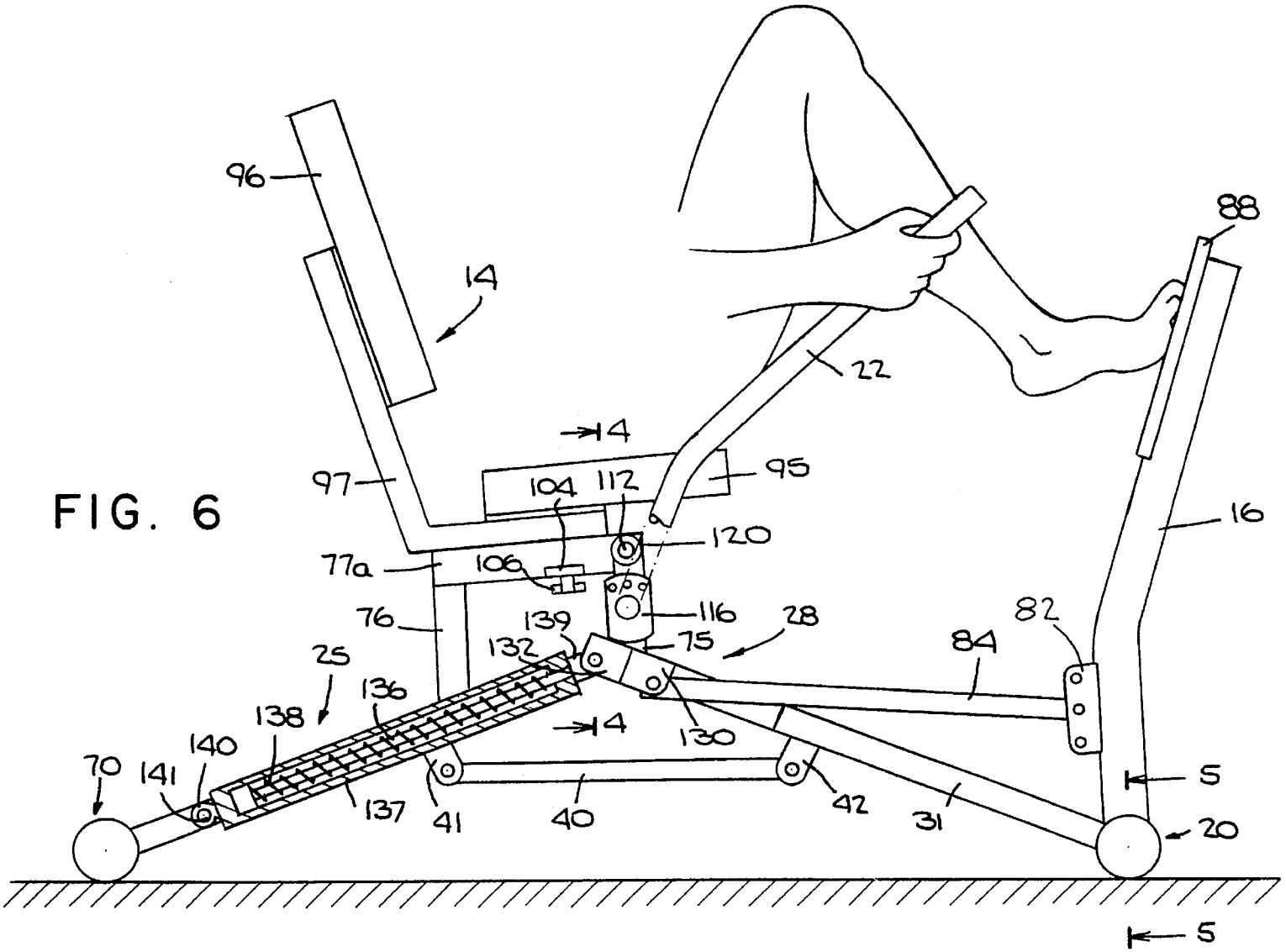
FIG. 6 is a side view of the apparatus depicted in FIG. 1, and the leg and arm of an exerciser respectively pushing the right foot lever and pulling the right arm lever of the apparatus at the start of an exercise cycle where the right foot lever and right arm lever are closest to each other, and with the right resistance device being shown schematically in section.

Referring to FIGS. 1 and 6, the seat 14 includes a seat bottom 95 and a seat back 96 which are attached to a generally L-shaped seat frame 97. Referring to FIGS. 3 and 4, the bottom portion 99 of the L-shaped seat frame 97 is slidably mounted to the horizontal segment 77 of the apparatus frame 12. The horizontal frame segment 77 includes two spaced bars 77*a*, 77*b* which slidably receive between them the bottom portion 99 of the seat frame 97, which is a U-shaped channel open at its bottom. A threaded shaft 101 is attached to the web of the bottom portion 99 of the seat frame 97 and projects through the space between the spaced frame bars 77*a*, 77*b* and through a hole 103 in the web of a U-shaped bracket 104 positioned at the bottom of the horizontal frame segment 77. A wing nut 106 tightened onto the threaded shaft 101 projecting through bracket 104 fixes the position of the seat 14 on the frame 12.

Referring to FIGS. 2 and 4, the arm levers 22 and 23 are pivotally connected to the frame 12 as follows. Each arm lever 22, 23 is fixed to a linking element which in the preferred embodiment is a leverage brace 110, which in turn is pivotally mounted to the frame 12 on a pivot shaft 112 which is fixed to the vertical frame segment 77 with substantially equal portions of the shaft projecting from opposite sides of the frame. Each arm lever 22, 23 has a hole 114 (FIG. 4) in the end thereof and a bracket 116 attached to the end of the arm lever. The bracket 116 has a hole 117 therethrough aligned with the hole 114 in the end of the respective arm lever. The hole 114 in the end of the arm levers 22, 23 and a bolt 118 have mating unthreaded larger diameter portions and mating threaded smaller diameter portions. Tightening the bolts 118 in the holes 114 of the respective arm levers fixes respective arm levers to respective leverage braces. Each leverage brace 110 also includes a collar 120 which pivotally receives a respective projecting end of pivot shaft 112 therein. Conventional means (not shown) are provided to removably secure the leverage braces 110 to the pivot shaft 112.

The right-side and left-side linkage systems 28 and 29 (FIG. 1) which link respective foot levers 16 and 17, respective arm levers 22 and 23, and respective resistance devices 25 and 26 include respective leverage braces 110 which also pivotally connect respective arm levers 22, 23 to the frame 12. Referring to FIGS. 2 and 6, each leverage brace 110 includes a forward bracket 130 and a rear bracket 132. Referring to FIG. 6, resistance devices 25, 26 are independent action, spring return hydraulic piston/cylinder devices, commonly referred to generally as shock absorbers. Resistance devices 25, 26 each include a piston 136, a cylinder 137 and a return spring 138. Referring to FIGS. 2 and 6, the forward bracket 130 is pivotally connected to the rear end of the link 84 and the rear bracket 132 is pivotally connected to the free end 139 of the piston 136. The end 140 of the cylinders 137 of the resistance devices 25, 26 are fixed to the rear frame piece 26 by a shaft 141 (FIGS. 3 and 6) which in turn is fixed to and extends through the frame. The ends 140 of the cylinders 137 are connected to opposite ends of the shaft 141.

The linkage systems 28 and 29 between the foot levers 16, 17, the arm levers 22, 23 and the resistance devices 25, 26 cause the right foot lever 16 and the right arm lever 22 to move in synchronism in opposite directions against the resistance of the right resistance device 25, and the left foot lever 17 and the left arm lever 23 to move in synchronism in opposite directions against the resistance of the left resistance device 26. The resistance devices 25, 26 extend below the seat and rearwardly thereof so that they are out of the way and not likely to be contacted by a recumbent exerciser when exercising. Since the resistance devices may become hot during use, such positioning of the resistance devices is a safety feature of the apparatus 10. Also, such positioning of the resistance devices below the seat to the rear the apparatus physically and visually out of the way enhances the aesthetic appeal of the apparatus 10.

Referring to FIG. 1, the upper portions of the arm levers 22, 23 slope forwardly towards the front of the apparatus, thereby placing the ends of the arm levers in a generally convenient starting position. In addition, the starting position of a respective arm lever 22, 23 relative to a respective foot lever 16, 17 may be adjusted by means of three holes 142 (FIGS. 1 and 2) spaced front to rear along the respective brackets 116 connected to the ends of the respective arm levers, and a pin 144 (FIG. 4) inserted through one of the holes 142 on a respective bracket 116 and into a hole 143 in a respective leverage brace 110. The starting position of the arm levers 22, 23 is adjusted by loosening the bolt 118, pulling the respective pin 144 out of holes 142 and 143, pivoting the arm lever to a new desired starting position, and pushing the pin 144 back through a respective hole 142 in the leverage brace 110, and then retightening the bolt 118. Selecting the frontmost hole 142 on the respective bracket 116 brings the respective arm lever closest to the seat 14.

Referring to FIGS. 1 and 2, the tension on the arm and foot levers may be adjusted externally of the resistance devices 25, 26 by repositioning the connection point of respective links 84 to respective brackets 82. Brackets 82 have vertically spaced holes 147 through which a link 84 is pivotally coupled to a bracket 82 by a bolt and nut (not shown). The lower the holes on the bracket 82 through which the bolt is anchored to pivot a link 84 to a respective bracket 82, the greater the tension on the respective foot and arm levers.

The right foot lever 16 and the right arm lever 22 move in synchronism (in opposite directions) and the left foot lever 17 and the left arm lever 23 move in synchronism (in opposite directions). However, in the embodiments of FIGS. 1–7 and 14–15, the right foot and arm levers 16, 22 and the left foot and arm levers 17, 23 move independently of each other, i.e., the right foot lever 16 is not coupled to the left foot lever 17 or the left arm lever 23, and the right arm lever 22 is not coupled to the left foot lever 17 or the left arm lever 23, and vice versa. As a result, the levers 16, 22 on one side of apparatus 10 operate independently from the levers 17, 23 on the other side so that apparatus 10 may be used in both stepper or rower fashion as desired by the exerciser.

Figure 7:
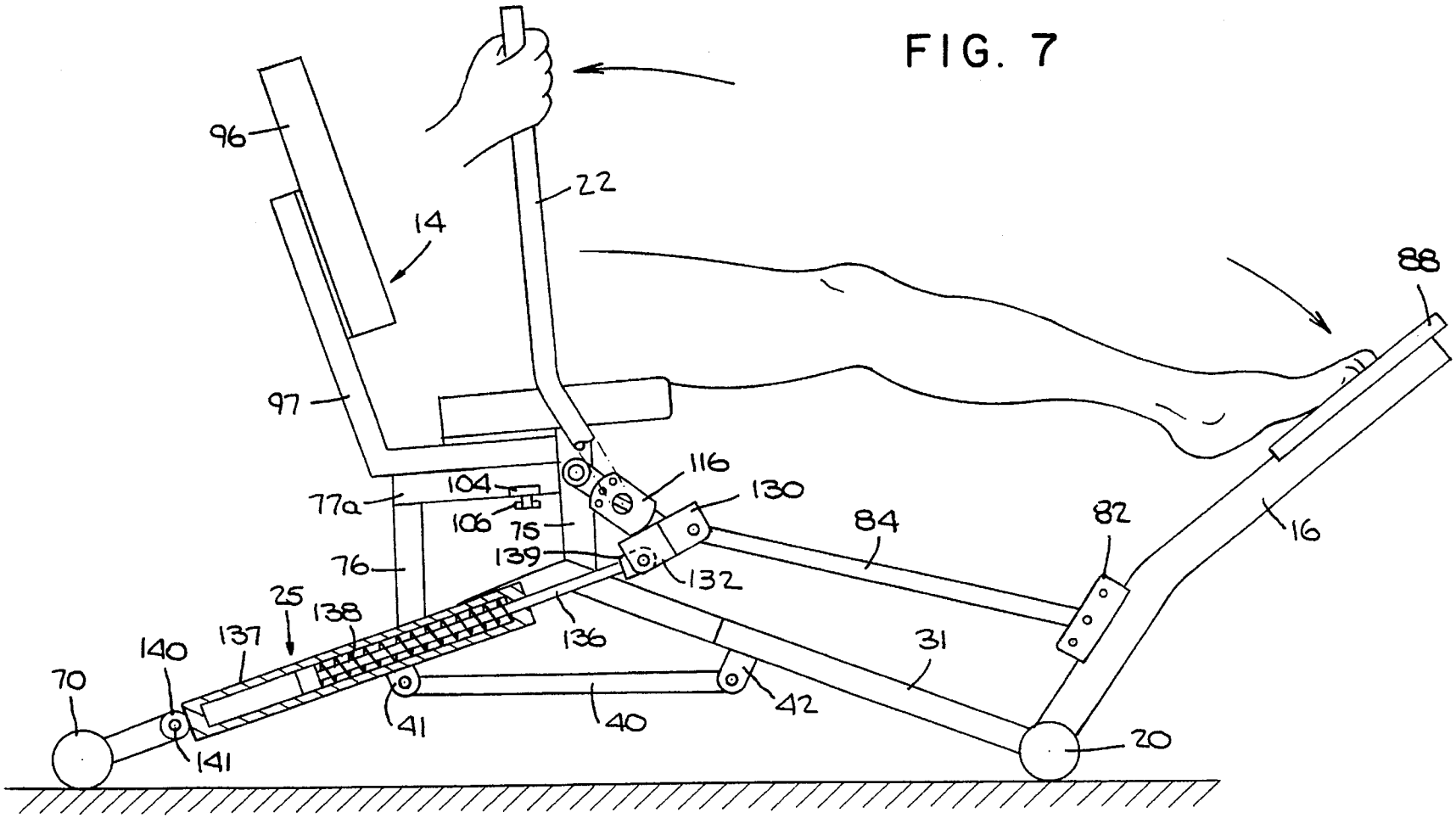
FIG. 7 is a side view similar to that of FIG. 6 but with the leg of the exerciser extended and the right foot and arm levers at the mid-point of the exercise cycle where the right foot lever and right arm lever are farthest from each other and ready to return towards the start position.

Referring to FIGS. 6 and 7, the resistance devices 25, 26 are constructed to provide substantial resistance to pulling the piston 136 out of the cylinder 137, and little resistance to pushing the piston 136 into the cylinder 137. Additionally, the return spring 138 urges the piston 136 into the cylinder 137. With such a resistance device construction, and the linkage systems 28 and 29, when the piston 137 is in the cylinder 137 as shown in FIG. 6, the foot levers 16, 17 and the arm levers 22, 23 are pivoted towards each other. This position in which the foot and arm levers are closest to each other is the starting position for an exercise cycle.

Figure 12:
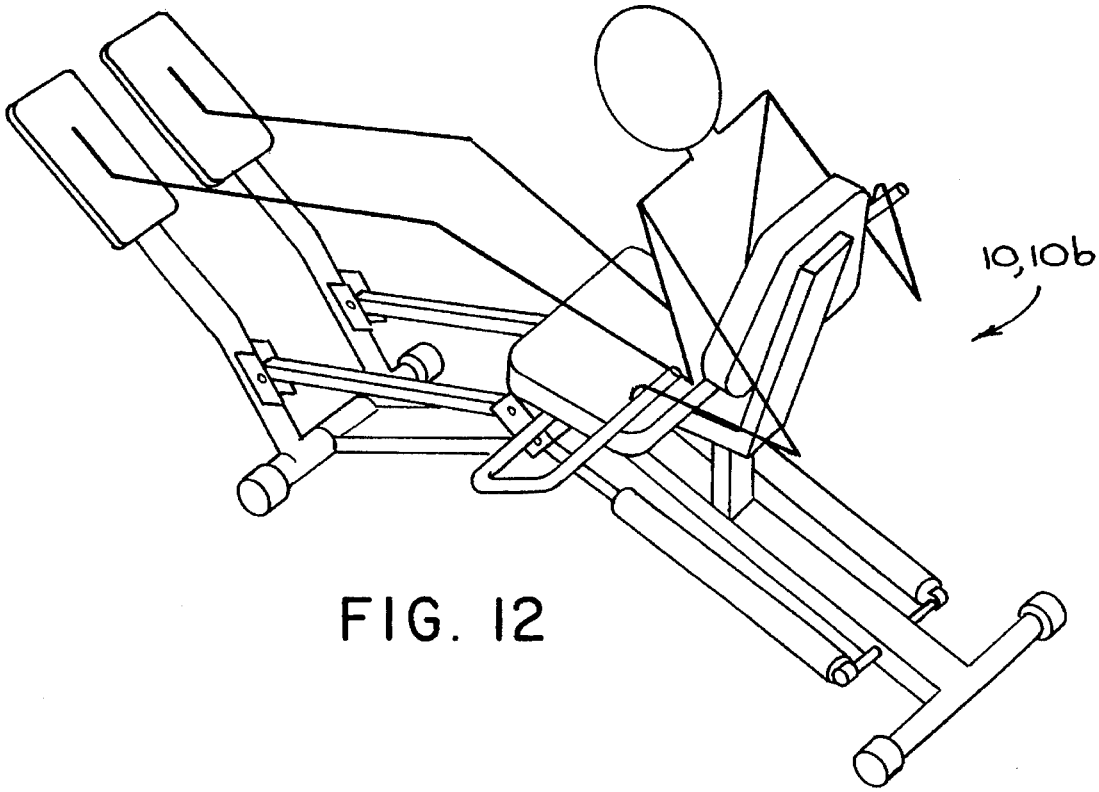
FIG. 12 is a perspective view of the apparatus of FIG. 1 or FIG. 9 with a stick figure illustrating operation of the apparatus as a rower.
Figure 13:
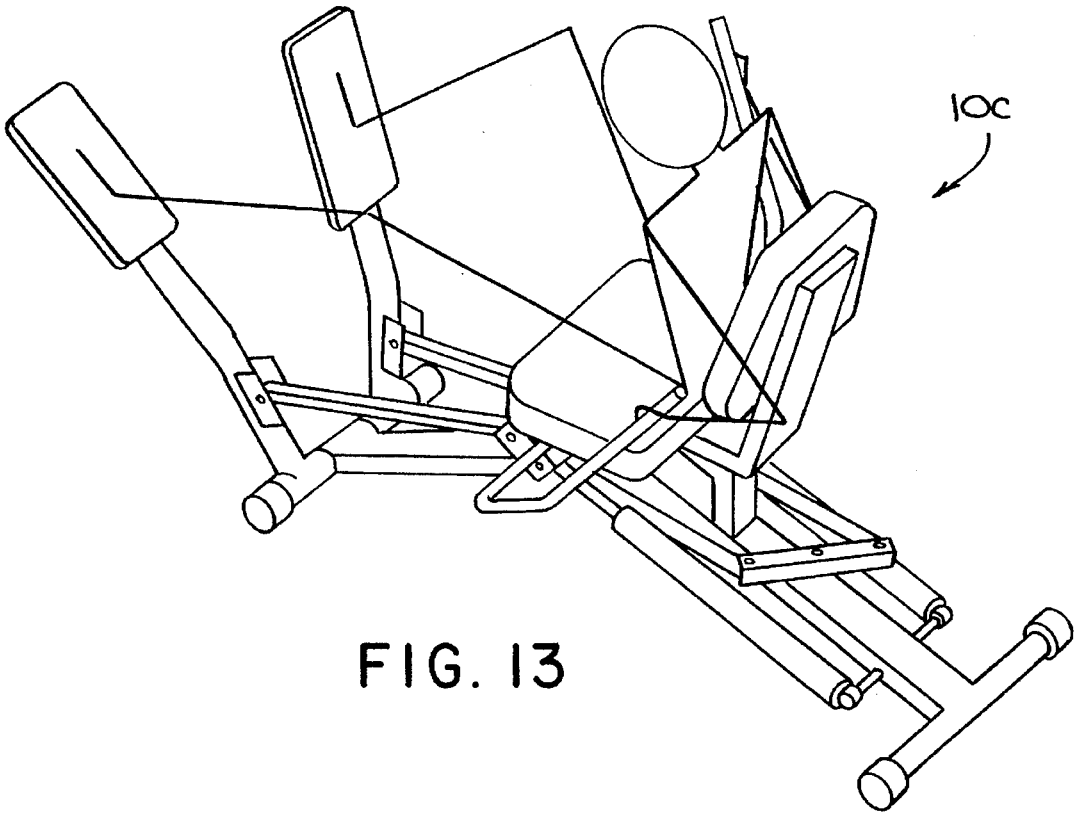
FIG. 13 is a perspective view of the apparatus of FIG. 10 with a stick figure illustrating operation of the apparatus as a recumbent stepper.

In the starting position shown in FIG. 6, an exerciser pushes the right foot lever 16 with his or her right foot and pulls the right arm lever 22 with his or her right hand until the mid-cycle position in which the exerciser's leg is extended, as shown in FIG. 7, is reached. From the mid-cycle position shown in FIG. 7, the exerciser can simply relax to allow the spring 138 to return the foot and arm levers to the FIG. 6 starting position, or can perform an isometric bench press type exercise by pushing on the arm levers while resisting with his or her feet the pivoting back of the foot levers. The above-described cycle applies to the right side levers and the left side levers, which may be operated with the right and left side levers moving in synchronism in the same directions as a rower, as illustrated in FIG. 12, or with the right and left side levers moving in synchronism in opposite directions as a stepper, as illustrated in FIG. 13.

One need not engage both the foot levers and the arm levers, and one may exercise only his or her legs by applying force to the foot levers but not to the arm levers, and only his or her arms by applying force to the arm levers but not the foot levers.

The exercising apparatus 10 is constructed so that the arm levers 22, 23 may be removed while allowing the foot levers, 16, 17 to remain operatively coupled in the apparatus simply by unscrewing bolt 18 (FIG. 3) and removing the arm levers 16, 17 from respective leverage braces 10.

Figure 8:
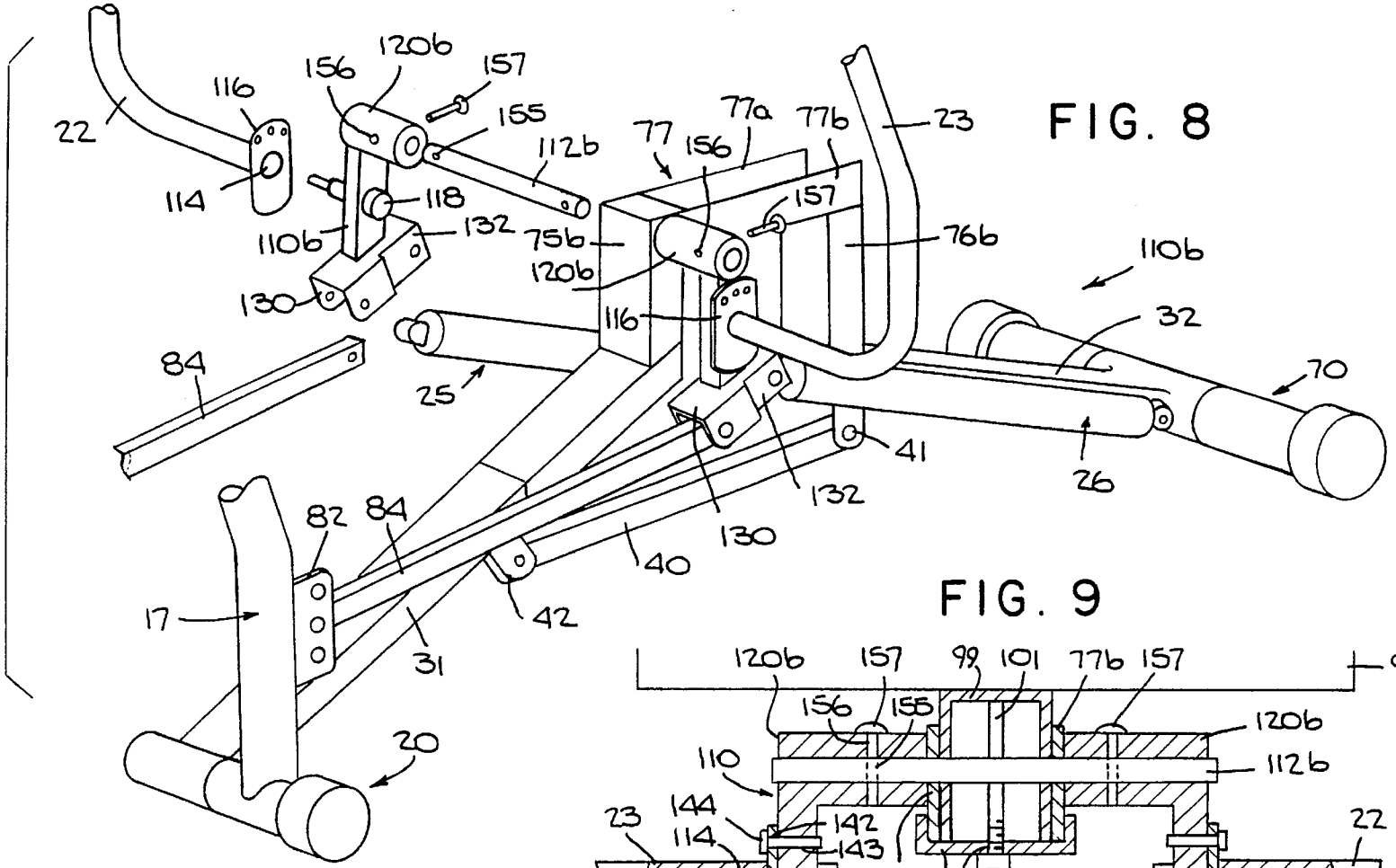
FIG. 8 is a perspective view of a leg and arm exercising apparatus according to another embodiment of the invention in which the foot levers, arm levers and resistance devices are all linked together so the apparatus operates as a rower, the seat and right foot levers not being shown, and part of the right side linkage system shown exploded.
Figure 9:
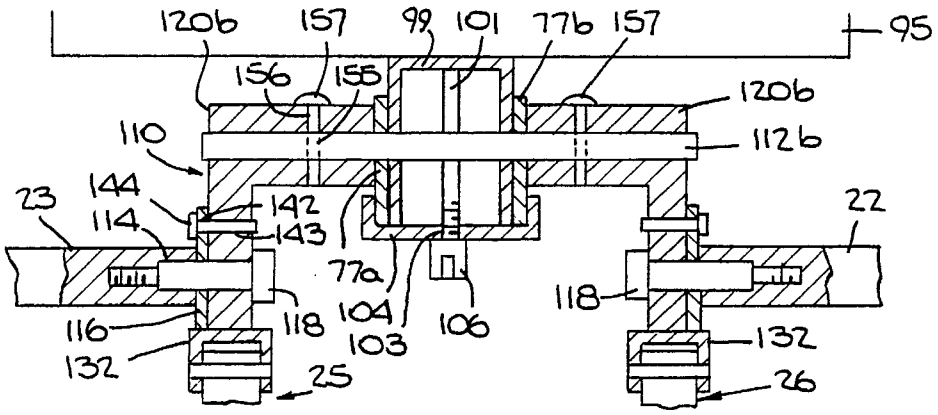
FIG. 9 is a vertical cross-sectional view of the embodiment depicted in FIG. 8 taken below the seat through part of the linkage system and the frame of that apparatus.

If desired, the linkage systems 28 and 29 may be interlinked to synchronize the right-and left-side levers either to move in the same direction as a rower or in opposite directions as a stepper. Referring to FIGS. 8 and 9, exercising apparatus **10*b* includes a shaft 112*b* which is rotatably mounted to the frame segment 75*b* and has holes 155 therein, and respective collars 120*b* of the leverage braces 110*b* which have holes 156 therein. A pin or screw 157 passes through respective holes 156, 155 to fix the respective collars 120*b* to the shaft 112*b* to rotate with the shaft. The right-side levers 16, 22 and left-side levers 17, 23 would then be forced to rotate in synchronism in the same direction as illustrated in FIG. 12**.

Figures 10, 11:
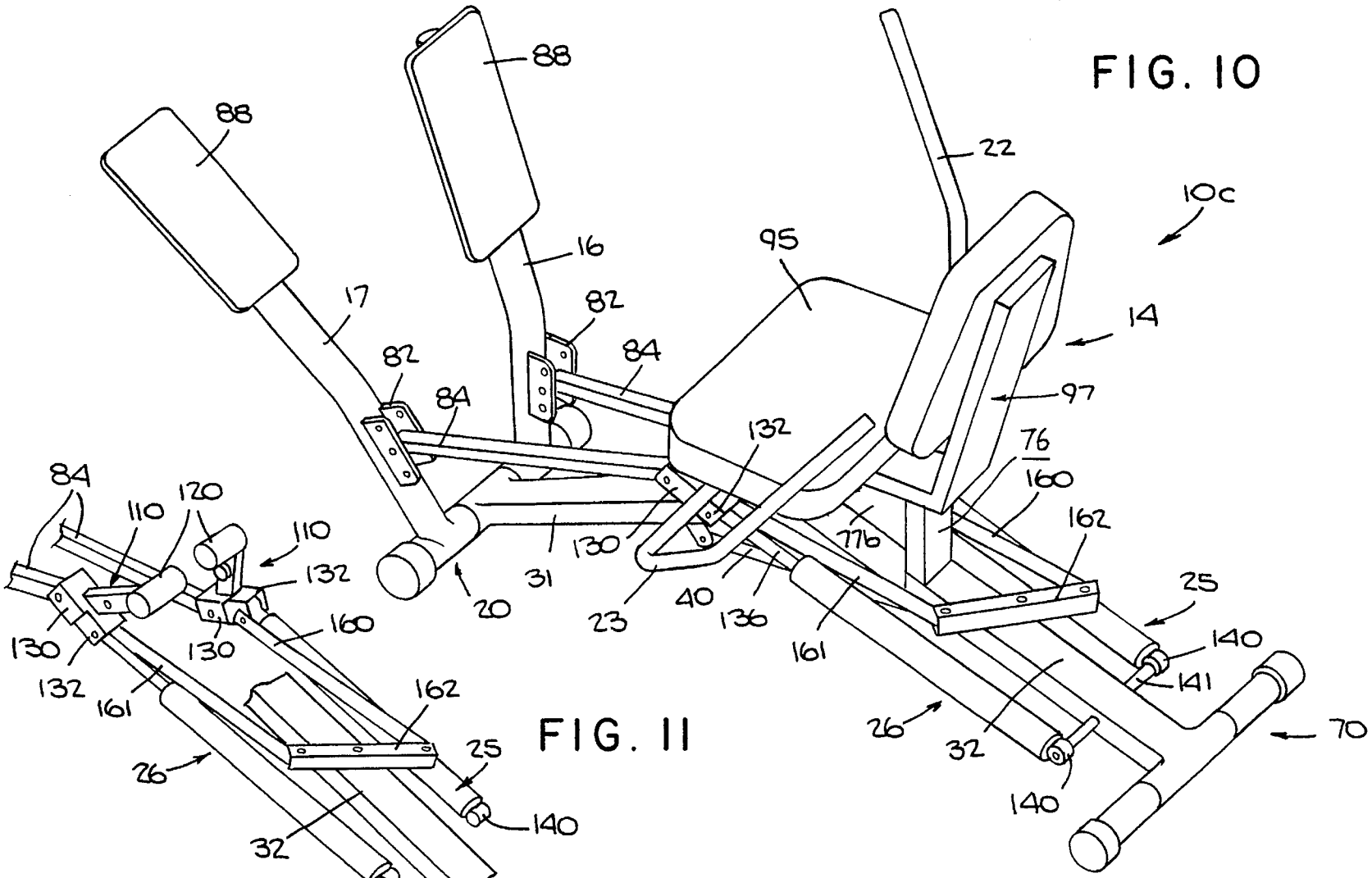
FIG. 10 is a perspective view of leg and arm exercising apparatus according to still another embodiment of the invention in which the foot levers, arm levers and resistance devices are all linked together so that the apparatus operates as a recumbent stepper.
FIG. 11 is a perspective view of part of the lever and resistance linkage system of the apparatus of FIG. 10 with the frame broken away and not showing the seat.

Also, if desired the linkage systems 28 and 29 may be interlinked to synchronize the right-and left-side levers to move in synchronism in opposite directions. Referring to FIGS. 10 and 11, in exercising apparatus **10*c* the right and left leverage braces 110 are linked by bars 160, 161 to a bar 162 pivoted to the rear piece 32 of frame 12. Each of bars 160,161 is pivoted at its forward end to a respective rear bracket 32 of a leverage brace 110, and is also each pivoted at its rear end to opposite ends of the bar 162. The bars 160, 161 and 162 are initially linked with levers on one side of apparatus 10*c* offset from the levers on the other side of apparatus 10*c*. Inter-linking the right and left side levers in that manner forces the right and left side levers to move in opposite directions in stepper fashion, as illustrated in FIG. 12**.

As discussed above, FIGS. 14 and 15 illustrate the presently preferred embodiment of exercising apparatus **10*a*, which is similar to the apparatus 10 illustrated in FIG. 1 with the differences described above, and FIGS. 16–19 illustrate a foot pedal 88*a* of the apparatus 10*a***.

While the invention has been described and illustrated in connection with preferred embodiments, many variations and modifications as will be evident to those skilled in this art may be made without departing from the spirit and scope of the invention. For example, different types of hydraulic or pneumatic resistance devices may be used and resistance devices (e.g., friction discs, elastic bands, etc.) other than hydraulic or pneumatic may be used. Also, the resistance devices may provide resistance in both directions of movement of the levers, whether equally or in different amounts. The invention as set forth in the appended claims is thus not to be limited to the precise details of construction described above.

What is claimed is:

1. A leg and arm exercising apparatus comprising:

a frame;

a seat attached to said frame;

first and second foot levers coupled to said apparatus to pivot in first and second opposite directions;

first and second arm levers coupled to said apparatus to pivot in the first and second directions between opposite end points;

means coupled to at least one of said levers for resisting pivoting of at least that lever in at least one of the first and second directions;

said seat and said levers being positioned such that an exerciser sitting in said seat may contact respective levers with respective limbs and pivot respective levers; and a linkage system coupled to said frame and linking each of said arm levers to a different one of said foot levers, each of said arm levers being pivotally adjustably coupled to said linkage system.

2. A limb exercising apparatus comprising:

a frame and at least one support coupled thereto for contacting a support surface and supporting said frame thereon;

a seat attached to said frame;

said frame comprising a first piece and a second piece, and at least one fastener removably connecting said first and second pieces together in a central portion thereof;

either or both (a) first and second foot levers coupled to said apparatus to pivot in first and second opposite directions, and (b) first and second arm levers coupled to said apparatus to pivot in the first and second directions;

said seat and said levers being positioned such that an exerciser sitting in said seat may contact respective levers with respective limbs and pivot respective levers; and means coupled to at least one of said levers for resisting pivoting of at least that lever in at least one of the first and second directions.

3. The apparatus of claim 2 comprising a projection in one of said pieces and a recess in the other of said pieces for removably receiving said projection, and said at least one fastener removably fastening said projection to said other piece in said recess thereof.

4. The apparatus of claim 3 comprising a brace removably fastened to one of said pieces and pivotally connected to the other of said pieces.

5. Exercising apparatus, comprising:

a frame;

a seat attached to said frame;

first and second foot levers coupled to said apparatus to pivot in first and second opposite directions;

a first linking element coupled to said frame to pivot in directions substantially parallel to said first and second directions and a first arm lever removably coupled to said first linking element to pivot therewith when coupled thereto;

a second linking element coupled to said frame to pivot in directions substantially parallel to said first and second directions and a second arm lever removably coupled to said second linking element to pivot therewith when coupled thereto;

first and second links respectively coupling said first and second linking elements to said first and second foot levers so that said first foot lever and said first arm lever pivot in synchronism and said second foot lever and said second arm lever pivot in synchronism, each of said first and second arm levers being removable from respective linking elements without affecting the pivoting of said first and second foot levers;

said apparatus being constructed so that an exerciser seated on said seat may exert force on respective foot levers with his or her respective feet and on respective arm levers when they are coupled to said apparatus with his or her respective hands; and resistance means coupled to said apparatus for resisting pivoting of at least one of said levers in at least one of said first and second directions.

6. The apparatus of claim 5 wherein each of said first and second arm levers are removable from respective linking elements without having to disconnect said first and second links.

7. The apparatus of claim 5 wherein said resistance means comprises a first piston and cylinder device coupled to resist movement of said first arm lever and said first foot lever, and a second piston and cylinder device coupled to resist movement of said second arm lever and said second foot lever.

8. The apparatus of claim 7 wherein said cylinder of said first device is coupled to said frame and said piston of said first device is coupled to said first linking element such that pivoting of said first linking element moves said piston of said first device relative to said cylinder of said first device and said frame, and wherein said cylinder of said second device is coupled to said frame and said piston of said second device is coupled to said second linking element such that pivoting of said second linking element moves said piston of said second device relative to said cylinder of said second device and said frame.

9. The apparatus of claim 8 wherein said first and second linking elements are positioned near said seat, said first and second piston and cylinder devices extend rearwardly of said seat, and said first and second links extend forwardly of said seat.

10. A leg and arm exercising apparatus comprising:

a frame;

a seat attached to said frame;

first and second foot levers coupled to said apparatus to pivot in first and second opposite directions;

a first linking element coupled to said frame to pivot in directions substantially parallel to said first and second directions, a first arm lever and means coupling said first arm lever to said first linking element to pivot therewith and so that the said first arm lever is pivotally adjustable relative to said frame;

a second linking element coupled to said frame to pivot in directions substantially parallel to said first and second directions, a second arm lever and means coupling said second arm lever to said second linking element to pivot therewith and so that the said second arm lever is pivotally adjustable relative to said frame;

first and second links respectively coupling said first and second linking elements to said first and second foot levers so that said first foot lever and said first arm lever pivot in synchronism and said second foot lever and said second arm lever pivot in synchronism;

said apparatus being constructed so that an exerciser seated on said seat may exert force on respective foot levers with his or her respective feet and on respective arm levers with his or her respective hands; and resistance means coupled to said apparatus for resisting pivoting of at least one of said levers in at least one of said first and second directions.

11. Exercising apparatus, comprising:

a frame;

a seat attached to said frame;

first and second foot levers coupled to said frame forwardly of said seat to pivot in first and second opposite directions;

first and second arm levers coupled to said frame near said seat and rearwardly of said first and second foot levers to pivot in directions substantially parallel to said first and second directions;

a linkage system respectively coupling said first and second arm levers to said first and second foot levers so that said first foot lever and said first arm lever pivot in synchronism and said second foot lever and said second arm lever pivot in synchronism;

a first piston and cylinder device extending rearwardly of said seat coupled to said frame to resist movement of said first arm lever and said first foot lever, and a second piston and cylinder device extending rearwardly of said seat coupled to said frame to resist movement of said second arm lever and said second foot lever;

said apparatus being constructed so that an exerciser seated on said seat may exert force on respective foot levers with his or her respective feet and on respective arm levers with his or her respective hands.

12. The apparatus of claim 11 wherein said linkage system comprises first and second links respectively coupling said first and second arm levers to said first and second foot levers, said links extending forwardly of said seat, a first linking element coupled to said frame near said seat to pivot in directions substantially parallel to said first and second directions, said first arm lever being coupled to said first linking element to pivot therewith, and a second linking element coupled to said frame near said seat to pivot in directions substantially parallel to said first and second directions, said second arm lever being coupled to said second linking element to pivot therewith.

13. The apparatus of claim 12 wherein said cylinder of said first device is coupled to said frame and said piston of said first device is coupled to said first linking element such that pivoting of said first linking element moves said piston of said first device relative to said cylinder of said first device and said frame, and wherein said cylinder of said second device is coupled to said frame and said piston of said second device is coupled to said second linking element such that pivoting of said second linking element moves said piston of said second device relative to said cylinder of said second device and said frame.

* * * * *